US006676064B1

(12) United States Patent
Nicolai

(10) Patent No.: US 6,676,064 B1
(45) Date of Patent: Jan. 13, 2004

(54) APPARATUS AND METHOD FOR INITIATING THE WINDING OF WEBS

(75) Inventor: Luc Marie Hubert Andre Nicolai, Heinsch (BE)

(73) Assignee: Du Pont Tejin Films, UK, Ltd., Cleveland (GB)

( * ) Notice: Subject to any disclaimer, the term of this patent is extended or adjusted under 35 U.S.C. 154(b) by 57 days.

(21) Appl. No.: 10/018,674

(22) PCT Filed: Jun. 14, 2000

(86) PCT No.: PCT/EP00/05437

§ 371 (c)(1),
(2), (4) Date: Apr. 24, 2002

(87) PCT Pub. No.: WO00/76895

PCT Pub. Date: Dec. 21, 2000

(30) Foreign Application Priority Data

Jun. 16, 1999 (EP) ..... 99401484

(51) Int. Cl.[7] ..... B65H 35/04
(52) U.S. Cl. ..... 242/527.2
(58) Field of Search ..... 242/527.2, 527.3, 242/527

(56) References Cited

U.S. PATENT DOCUMENTS 2,942,796 A * 6/1960 Gurney et al.
3,341,144 A * 9/1967 Mase
3,796,388 A * 3/1974 Davis

FOREIGN PATENT DOCUMENTS

| | | |
|---|---|---|
| DE | 3033765 | * 10/1981 |
| DE | 3239922 | * 5/1984 |
| EP | 0067051 | * 12/1982 |
| EP | 0606662 | * 7/1994 |
| EP | 0683019 | * 11/1995 |
| FR | 2320886 | * 3/1977 |
| FR | 2637832 | * 4/1990 |

* cited by examiner

*Primary Examiner*—John Q. Nguyen

(57) ABSTRACT

The instant invention relates to an apparatus for winding a web arriving from a conveyance direction, comprising: primary winding roll (3) and secondary driving means (2), switching means (4*a*, 4*b*) for switching the winding from the secondary means (2) to the primary winding roll (3), and cutting means (5) to cut the at least one web (1) between the primary winding roll (3) and the secondary driving means (2), wherein the switching means comprise diverting (4*b*) situated opposite to the primary winding roll (3) with respect to the at least one web (1), said diverting means being movable along a transverse direction (G) intersecting the conveyance direction (F) to entrain the at least one web (1) towards the primary winding roll (3), whereby the at least one web (1) is cut and caused to be wound on the primary winding roll (3). The invention also relates to a method for winding a web, especially using the apparatus of the invention as well as a double pantograph frame suited to be used with said apparatus.

20 Claims, 5 Drawing Sheets

APPARATUS AND METHOD FOR INITIATING THE WINDING OF WEBS

FIELD OF THE INVENTION

The invention relates to an apparatus and a method for initiating the winding of webs on rolls, as well as a double pantograph frame suited to be used with said apparatus.

BACKGROUND OF THE INVENTION

In general, webs such as thin polyester foils or other sheet materials are manufactured in a continuous process and the final products are wound up on rolls for storage and transportation.

However, the continuous process of manufacturing is often interrupted by breaks of the web and the winding on the rolls has to start again. One possibility is to stop the manufacturing upstream from the winding unit; this however is obviously to be avoided. In case manufacturing is continued, the part of the web that is not wound up on the roll must be taken care of. For example, one possibility for restarting a winding unit after break is to wind a certain amount of the web on an auxiliary roll or to direct this amount of web towards a chute, until the irregularities of the break are overcome and later to continue the winding on the nominal roll after cutting of the web, in a controlled manner, from the auxiliary roll or from the chute. However, the switching from the auxiliary roll or the chute to the nominal roll and the controlled cutting are complicate and time consuming and therefore expensive.

The problem is even more severe when several nominal rolls of minor size are wound up simultaneously from the same large web by splitting the web along the conveyance direction before winding. Up to now it was necessary to stop the winding of all rolls even when the break affected only one of the rolls resulting in a additional work load and higher manufacturing costs.

The problem is acute for (ultra) thin films with thickness as low as the micron size and speeds up to 1000 m/min. One solution is to blast air on a web to divert it into a winding unit, where the air blast is controlled so that the web will come at the vicinity of the nip point of two rolls, allowing starting of winding. This way of operating suffers from obvious drawbacks, i.e. harshness of the method that destroys films and difficulties for adapting the proper conditions to achieve a proper winding.

Thus, there is a need for an apparatus and a method that will allow the (re)starting of the winding of (ultra) thin films at high speed.

SUMMARY OF THE INVENTION

The object of the present invention is to provide an apparatus and a method for starting the winding of webs on winding rolls, allowing an easy and fast start/restart of the winding for one or several nominal rolls thereby reducing the work load and the manufacturing costs.

The object is achieved with an apparatus according to claim 1 and 24 and a method according to claim 29 and 37 as well as with a double pantograph frame according to claim 26. Preferred embodiments are defined in the depending claims.

The apparatus and the method as defined above have the advantage to allow an easy and fast switching from the secondary driving roll to the primary winding roll. With the secondary driving roll being an auxiliary roll and the primary winding roll being the storage roll of the final product, the invention allows for a simple and fast start up of the winding on the latter.

DETAILED DESCRIPTION OF THE INVENTION

Figure 1A:
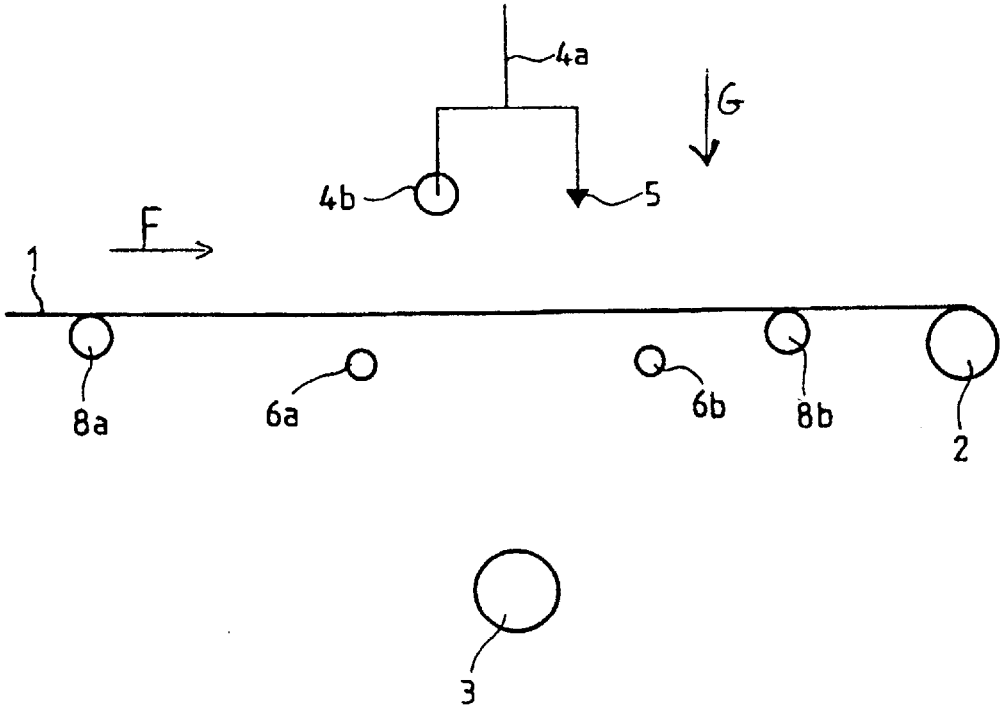
FIGS. 1*a* to 1*f* are schematic side views of an apparatus according to the invention, further illustrating the operating of said apparatus.
Figure 1B:
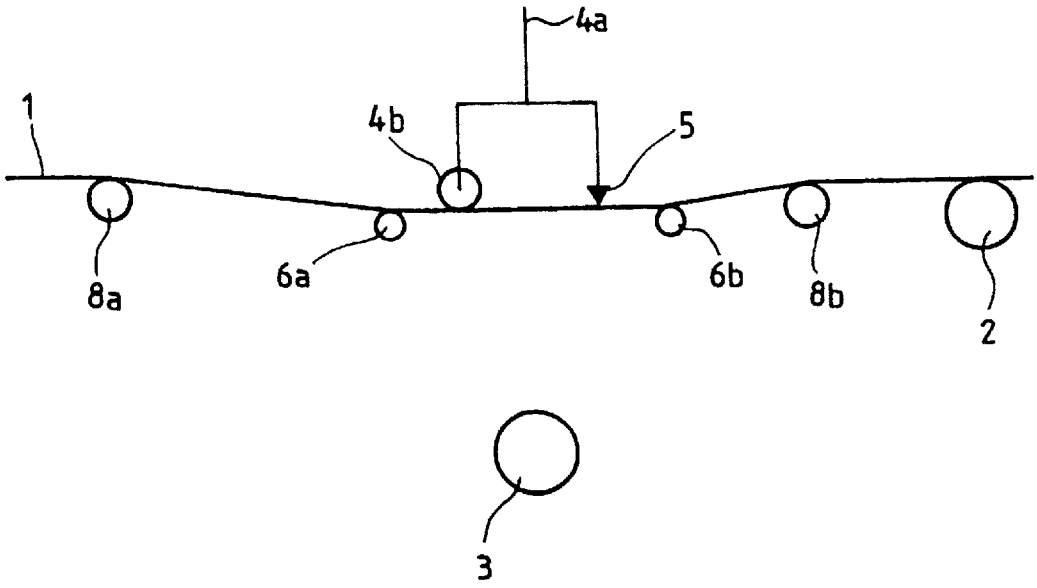
Figure 1C:
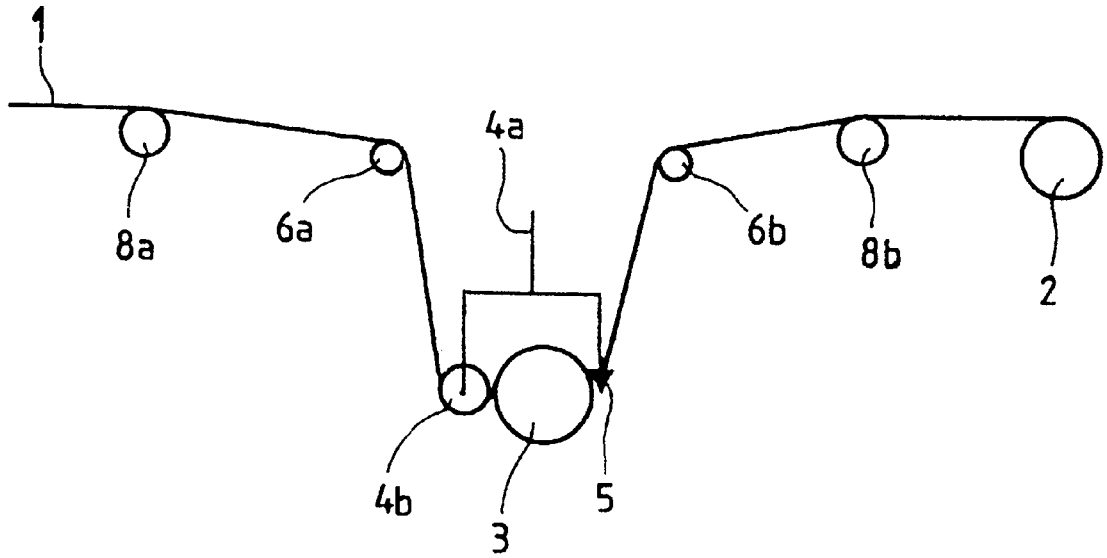
Figure 1D:
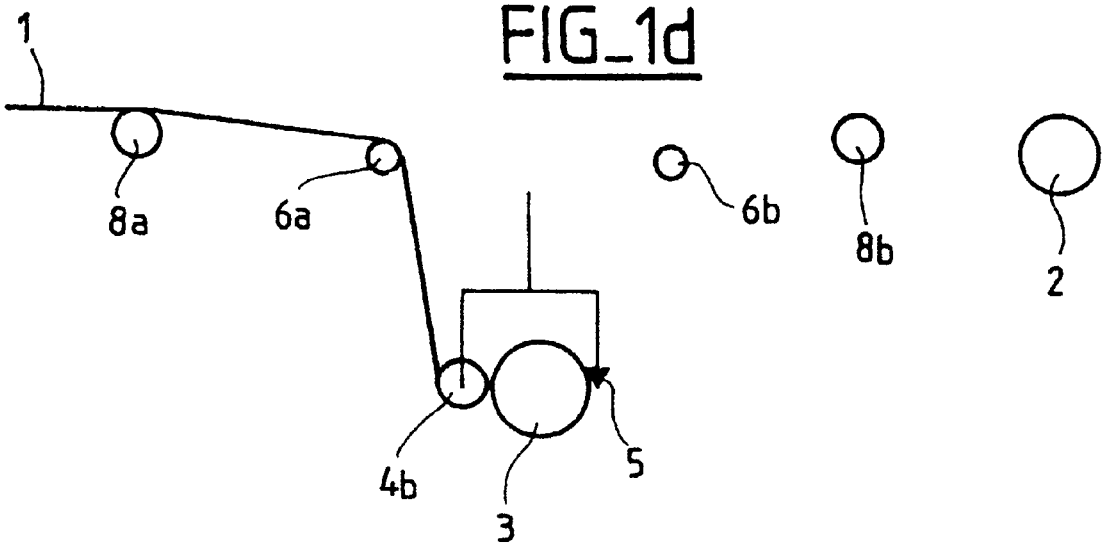
Figure 1E:
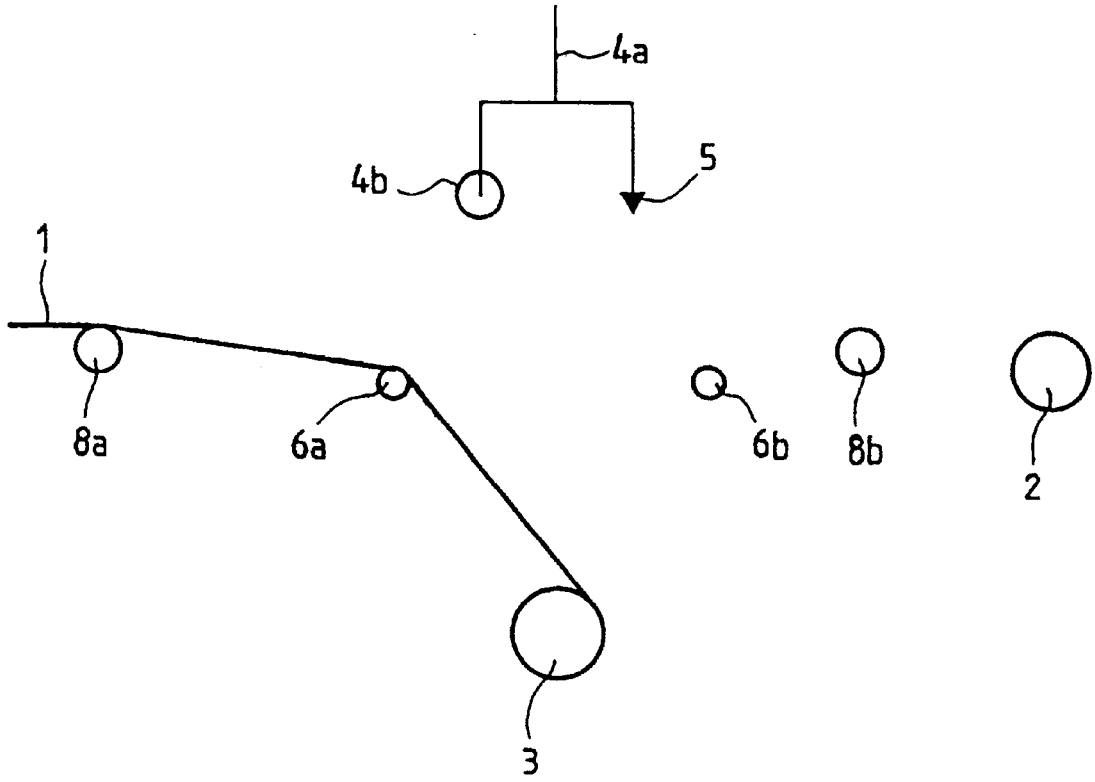
Figure 1F:
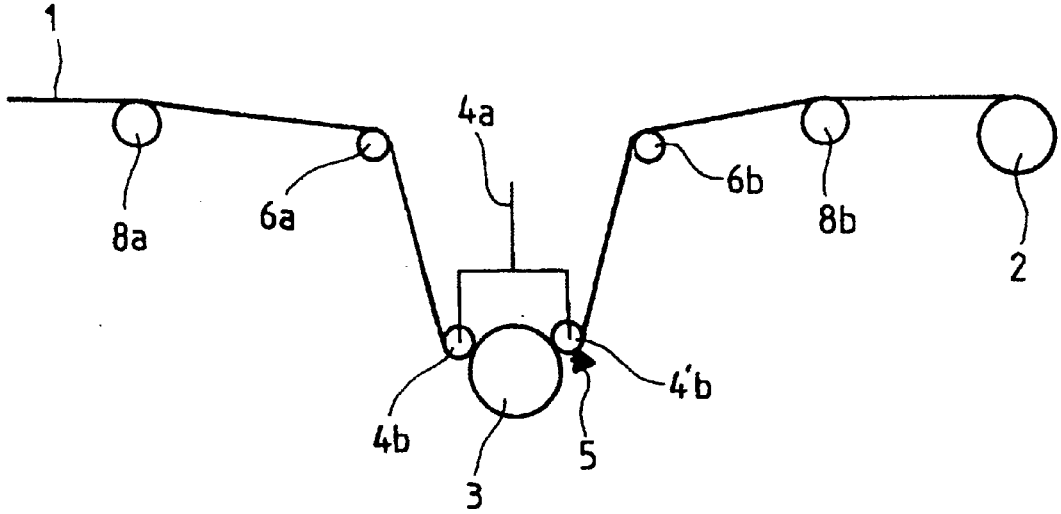
Figure 2:
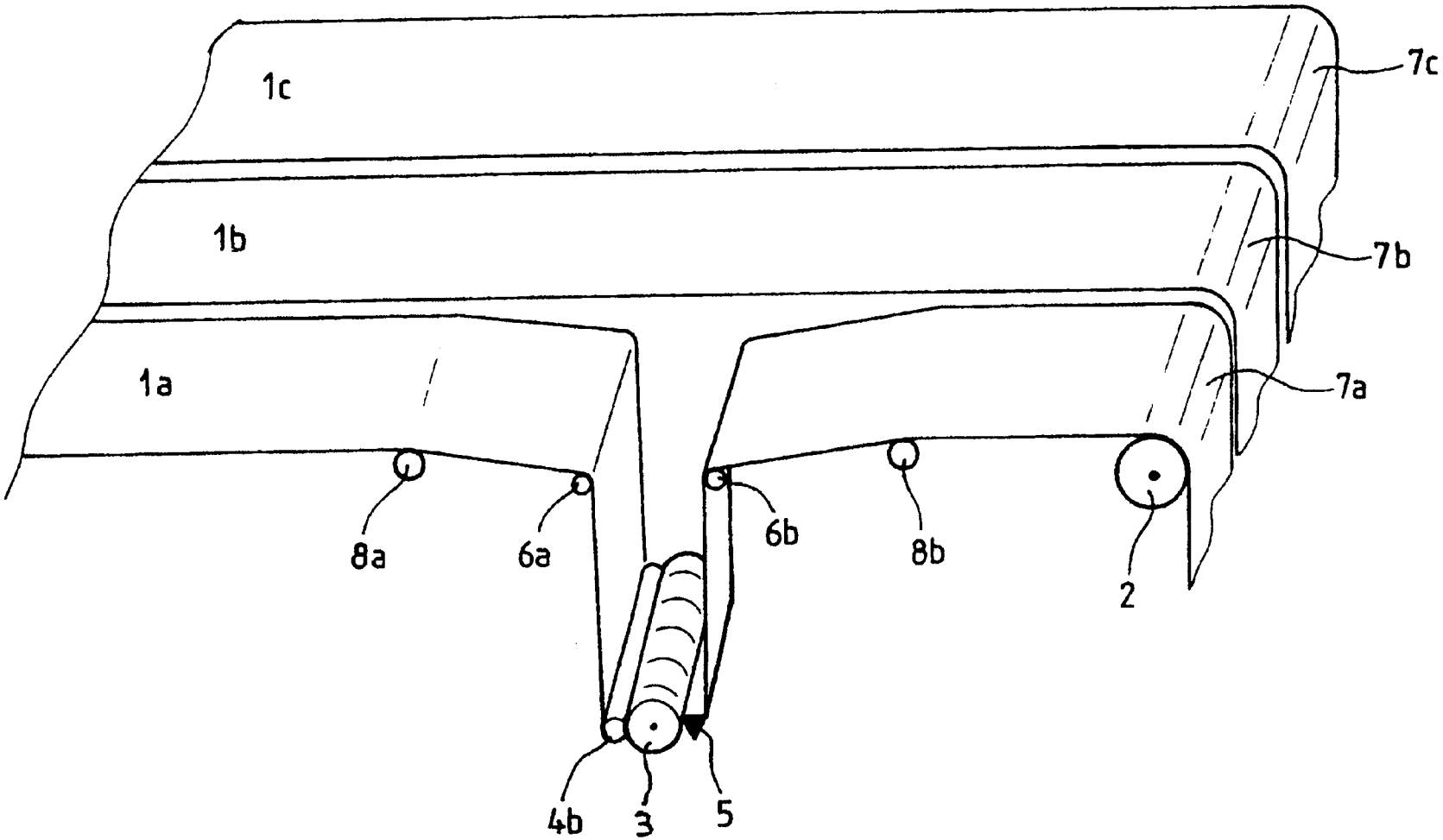
FIG. 2 is a schematic perspective view of an apparatus according to the invention functioning for three webs.

FIGS. 1*a* to 1*h* show the apparatus of the invention with respect to one unitary web, while FIG. 2 shows it for three webs.

FIG. 1*a* shows an apparatus according to the present invention for one unitary web. A web 1 such as a polyester foil arrives from a conveyance direction indicated by arrow F. In FIG. 1*a*, the apparatus is at the start point, i.e. the web is driven or wound on the secondary roll 2, with a winding speed w1. This part of web 1 can be either wound up on roll 2, or roll 2 can be a driving roll for directing web 1 into a chute (not shown). Roll 2 could be simply replaced by a chute having sucking means. To initiate the driving of web 1 on secondary roll 2, it is possible to use any means known in the art as for example, a leader system, a web transport table or suction channels; it may even be initiated by hand. Whatever the function performed, secondary roll 2 is designated below as the secondary driving roll. It shall be understood that said secondary roll is only an example of what can be a secondary means. As a matter of fact, a suction means connected to a chute or a chopper can also be used as the secondary driving means. The following description will be given with respect to a secondary driving roll 2.

In FIG. 1*a*, the primary winding roll 3 is situated below web 1, upstream with respect to secondary roll 2. The switching means 4*a*, 4*b* are situated above web 1, also upstream with respect to the secondary roll. Switching means 4*a*, 4*b* and primary winding roll 3 are aligned according to a direction which is substantially perpendicular to the web. Another direction, transverse would also be appropriate. The switching means are represented in FIG. 1*a* in the stand-by position.

The cutting means 5 can be located either at the vicinity of winding roll 3 or can be grouped with switching means 4*a*, 4*b*. FIG. 1*a* shows an apparatus where switching means 4*a*, 4*b* and cutting means 5 are grouped. Cutting means 5 are preferably as wide as web 1 in order to allow the transversal cutting of web 1 in one stroke. However, instead of being as wide as web 1, cutting means 5 may also be narrow and move transversally, hereby creating a diagonal cut. The cutting element may be of any type: straight or toothed blade cutting in the air, circular blade, shear knife, laser means, waterjet means.

Switching means 4*a*, 4*b* are movable along a transverse direction, as indicated by arrow G, in such a way that the moving path intersects the conveyance direction F. Switching means comprise diverting means 4*b* and entraining means 4*a*, diverting means 4*b* being a roll, preferably an idle roll, entraining means 4*a* being shown as a translating carriage. The actuating means necessary for activating the switching means are not shown; they can comprise a motor transmitting its movement via gears, screw, etc. Cutting means 5 are located downstream with respect to diverting roll 4*b*. In the shown embodiment, cutting means 5 further comprise sliding means on which the web can slide without damage, the cutting element (i.e. a wide toothed blade) of cutting means 5 being retractable (to avoid unwished cutting of the web) and activated at the desired time. Cutting means 5 (when the cutting element is retracted) also act as diverting means (through said sliding means) in complement with roll 4*b*. This will be more apparent with respect to FIG. 3 below.

One pair of support rolls 6*a* and 6*b* (preferably of the idle roll type) are placed below the web, left and right with respect to switching means 4*a*, 4*b* and primary winding roll 3. Additional support rolls 8*a*, 8*b* may be disposed higher than support rolls 6*a*, 6. The function of said support rolls 6*a* and 6*b* is to support the conveyance of web 1 during the initiating of the winding on primary winding roll 3, i.e. when the switching means are in operation. Support rolls 6*a*, 8*a* on the left side may continue to support the conveyance of web 1 after that winding has been initiated on primary winding roll 3. More generally, web 1 is conveyed in the apparatus according to means and methods known in the art.

The method of operation of the apparatus according to the invention is illustrated in FIGS. 1*a* to 1*f*.

As already indicated, FIG. 1*a* shows the situation with switching means 4*a*, 4*b* in a standby position not intersecting the conveyance path of web 1. The winding of web 1 takes place on secondary roll 2 with a given rotation speed w1.

In FIG. 1*b*, the switching means are lowered with diverting roll 4*b* as well as cutting means 5 (its cutting element being in retracted position to avoid cutting the web, as already mentioned) contacting the conveyed web 1 and entraining the web into a lower position, where web 1 is brought into contact with support rolls 6*a*, 6*b* after being in contact with support rolls 8*a*, 8*b*. The step of the lowering procedure of the switching means involves a prolongation of the conveyance path of the web, and thus the rotation speed of secondary roll 2 is decreasing to a speed w2 which is lower than w1 (w2<w1) so that the tension in web 1 is preferably kept substantially constant.

In FIG. 1*c* the switching means are at their lowest position, where web 1 thus forms a loop. When the switching means have finally reached this lowest end position, the rotation speed of secondary roll 2 will resume a speed w3 equal to w1. In this position, diverting roll 4*b* is preferably in contact (through web 1) with primary winding roll 3, thus laying properly web 1 onto roll 3 and excluding the air between web 1 and roll 3. Web 1 envelopes the upper part of winding roll 3 from diverting roll 4*b* till cutting means 5 which are preferably located on the opposite side of roll 3 (without being in contact with it) with respect to diverting roll 4*b*. Diverting roll 4*b* and cutting means 5 are preferably disposed on each side of winding roll 3 so that web 1 is caused to envelope a substantial part of the circumference of winding roll 3, preferably half of it. One will understand that web 1 is such that it forms a W. where the middle position is on the top of winding roll 3 and the lowest position at the bottom of diverting roll 4*b* and of the sliding means of cutting means S. Also, one will understand that winding roll 3 is given an appropriate rotation speed (in the same direction than web 1 is moving) before it is contacted by web 1 thus preventing cutting or destroying said web.

Once the switching means are in the lowest position as shown in FIG. 1*c*, the cutting element of cutting means 5 is activated as shown in FIG. 1*d*, i.e. the cutting blade is brought into contact with web 1. Hence, web 1 is cut and caused to be wound up on winding roll 3. The cutting element is then retracted in order not to hinder the correct initiation of the winding on primary winding roll 3. During the cutting operation, cutting means 5 (including its cutting element) preferably do not enter into contact with primary winding roll 3 itself (or with the web already wound on the latter). Initiation of winding on roll 3 is automatically obtained due to the fact that web 1 is already enveloping a part of the circumference of said roll and will remain adhered on it due to the above mentioned air exclusion (in addition to that, other means like electrostatic effect or water spraying may be used). Web 1 is preferably cut in the vicinity of primary winding roll 3, as shown, and more preferably at a distance of 0,1 to 20 mm from roll 3. Thus, this will avoid to the maximum that a flying loose end of web 1 hinders winding on roll 3 or wrinkles onto roll 3 over which web 1 is to be wound. Preferably, cutting means 5 are maintained at a substantially identical distance of winding roll 3, whatever are its diameter and the amount of web already wound on it. Once web 1 is cut by cutting means 5, secondary roll 2 can stop rotating.

The actual rotation speeds of secondary roll 2 and primary roll 3 (as well as the rotation speeds of other rolls, if relevant) can be controlled by a torque control means (not shown, known per se), so as to avoid any possible overstretching of web 1 during lowering of switching means 4*a*, 4*b* and switching of web 1 from the secondary to the primary roll. For instance, it is possible to use a D.C. motor at constant current to drive secondary roll 2 in order to obtain a constant torque, i.e. a constant tension in web 1.

In FIG. 1*e*, the switching means are brought back to the stand-by position.

Assuming now that web 1 is broken at one stage of the process, the winding on roll 3 will then be stopped, and web 1 will again be wound on secondary roll 2. The thread up method described above can then be repeated immediately.

Not shown are the means for initially conveying web 1 from the production apparatus into the described apparatus; these means are well known per se in the art. Also, winding roll 3 can be classically coupled with another winding roll, through rotating arms, for example in order to replace the first one if wished (for example, when it is fully wound or to switch from a starting roll to a nominal roll).

FIG. 1*f* shows another embodiment, at a stage corresponding to FIG. 1*c*. In this case, the switching means comprises two diverting rolls 4*b*, 4'*b* that will come in contact at each side of winding roll 3, the cutting means being located in the vicinity of winding roll 3 and of one of the diverting rolls. In this case, cutting means 5 are not coupled with switching means 4*a*, 4*b*, but mounted in the region of winding roll 3.

It should be understood that the described embodiments allow to initiate the winding on empty rolls as well as on rolls already supporting some wound web.

The apparatus of the invention is especially suited for the winding of a web split into smaller webs. FIG. 2 is a schematical view showing several winding apparatuses according to the invention in parallel for winding a split web 1 (i.e. webs 1*a*, 1*b*, 1*c*) onto several corresponding primary winding rolls 3 (only a first one is shown). It further comprises secondary driving means for driving each web 1*a*, 1*b*, 1*c* at a proper speed. For example, the secondary driving means shown on FIG. 2 comprises an idle segmented roll (2) wherein each segment 7*a*, 7*b*, 7*c* corrresponds to a respective web each of which is driven at an own speed by a respective chute (not shown). Of course, a person skilled in the art may imagine other types of secondary driving means able to fullfill this purpose. The apparatus is represented with webs 1*b* and 1*c* wound up on the secondary roll 2, and with web 1*a* (corresponding to the front winding roll) being engaged at a stage as described on FIG. 1*c*. With respect to web 1*a*, are only represented elements 8*a*, 6*a*, 6*b*, 8*b* (for conveying the web), winding roll 3, diverting roll 4*b* and the cutting means 5.

Assuming now that each web 1*a*, 1*b* and 1*c* is wound on secondary roll 2, i.e. on segments 7*a*, 7*b* and 7*c*, then when the lowering of the switching means for one web 1*a* of concern is initiated, the rotation speed (wa) can be different from the rotation speed of the neighboring segment (wb) so as to maintain preferably the respective constant tension in webs 1*a*, 1*b*, 1*c*. Also, when a break occurs in one of webs 1*a*, 1*b*, 1*c*, the restart procedure may be performed only for the corresponding apparatus using the corresponding segment 7*a*, 7*b*, 7*c* of the segmented roll 2 while the winding on the other apparatuses continues uninterrupted. Thus, the other winding rolls continue to perform and the loss of web can be minimized.

Figure 3:
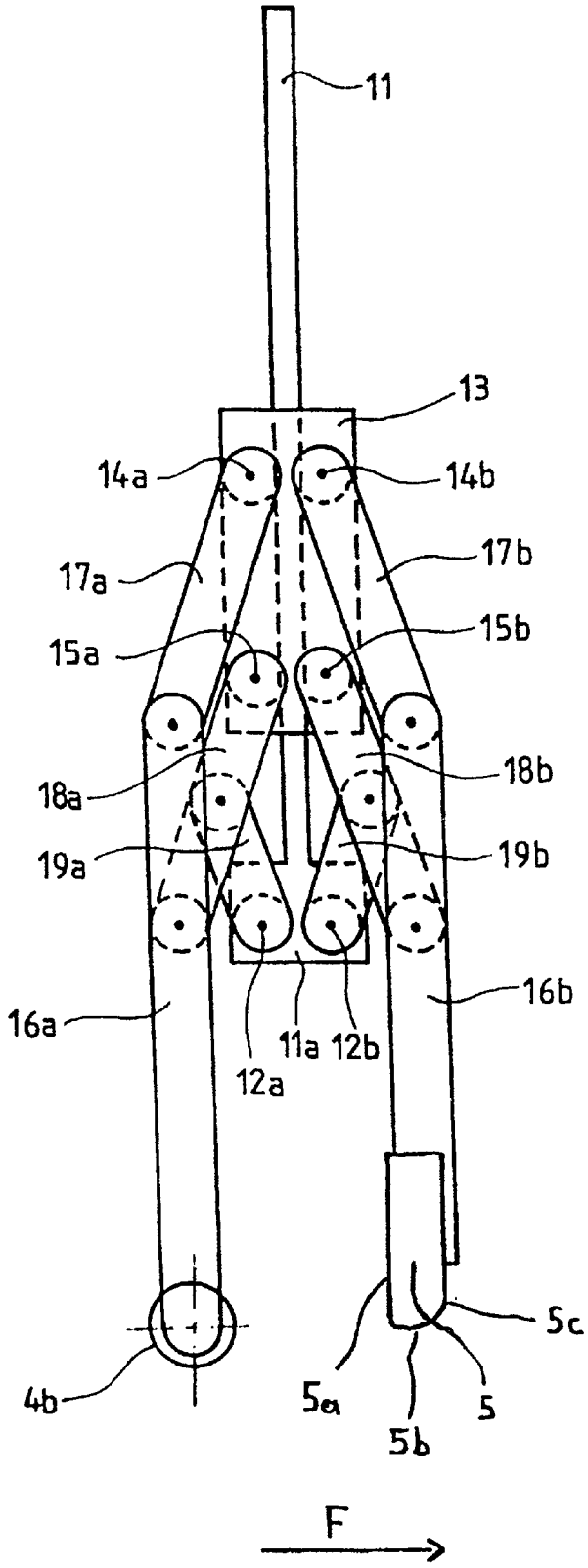
FIG. 3 is an enlarged view of a switching means according to the invention.

FIG. 3 shows an enlarged view of a preferred switching means, comprising a double pantograph frame. Cutting means 5 comprise sliding faces 5*a*, 5*b*, 5*c* on which web 1 can safely slide while the cutting element 5*d*, preferably a blade, is retracted between said faces (blade 5*d* is not represented). Entraining means 4*a* carrying the diverting idle roll 4*b* and cutting means 5 comprise the following elements: a movable T-shaped support 11, on the horizontal part 11*a* of which are mounted two ball bearings 12*a* and 12*b*. On the vertical part of support 11 is stidably mounted a carriage 13, said carriage comprising two pairs of ball bearings 14*a*, 14*b*, 15*a* and 15*b*. A first pantograph (the left one) is obtained by two parallel arms 17*a*, 18*a* articulated on carriage 13 (via ball bearings 14*a*, respectively 15*a*) and on arm 16*a* (also through ball bearings). Symmetrically, a second pantograph (the right one) is obtained by two parallel arms 17*b*, 18*b* articulated on carriage 13 (via ball bearings 14*b*, respectively 15*b*) and on arm 16*b* (also through ball bearings). Arms 16*a* and 16*b* bear respectively diverting roll 4*b* and cutting means 5, cutting means 5 being adjustable along direction F with respect to arm 16*b* in order to ensure a defined gap (in preferably the above mentioned range from 0,1 to 20 mm) between winding roll 3 and cutting means 5. An arm 19*a* is articulated on support 11 (via ball bearing 12*a*) and on arm 18*a*. Symmetrically, an arm 19*b* is articulated on support 11 (via hall bearing 12*b*) and on arm 18*b*. By translating carriage 13 With respect to support 11, diverting roll 4*b* and cutting means 5 are moved symmetrically with respect to each other. Additional means for retracting the pantograph frame to a closed position (i.e. the narrowest position of arms 16*a*, 16*b* as shown in FIG. 3) can be provided, e.g. as a spring. When the switching means are lowered down to primary winding roll 3, diverting roll 4*b* abuts on the left side of said roll 3 (through web 1) and the left pantograph opens to an extent depending on the diameter of roll 3. Thus, the right pantograph opens to the same extent, and consequently, as the plane of symmetry of the double pantograph frame comprises the axis of rotation of the winding roll 3, the adjusted gap between cutting means 5 and winding roll 3 remains substantially identical regardless the diameter of roll 3. More generally, these switching means can accommodate cores or winding rolls of various diameter (and can, after cutting, follow the increase of diameter while winding on roll 3 if the switching means are not immediately retracted after initiating the winding) and nevertheless allows to embody the preferred characteristics detailed in relation with FIGS. 1*e* and 1*d*. The double pantograph frame of FIG. 3 may also be adapted for use in the embodiment of FIG. 1*f*, in which case a second roll 4'*b* is fitted at the end of arm 16*b* instead of cutting means 5.

The invention was described with reference to preferred embodiments. However, many variations are possible within the scope of the invention; for instance the driving or winding roll can be any combination of one or more rolls, optionally of varying diameters.

What is claimed is:

1. An apparatus for initiating the winding on a roll of at least one web arriving from a conveyance direction, comprising:

a primary winding roll;

secondary driving means for driving the web in a web path;

cutting means; and switching means for switching the web driven in said web path by said secondary driving means to said primary winding roll;

wherein:

cutting means are mounted on said switching means;

said switching means comprise diverting means for contacting the web, said diverting means being located opposite to said primary winding roll with respect to the web driven by said secondary driving means and said switching means being movable towards said primary winding roll, so as to intersect said web path, whereby the web is cut by said cutting means and caused to be wound on said primary winding roll;

said diverting means comprise two parts contacting the web according to two longitudinally spaced regions, said two parts being able to position on opposite sides of said primary winding roll; and said diverting means are movable at least till the proximity of said primary winding roll so that they cause the web to contact substantially a half of a circumference of said primary winding roll.

2. The apparatus according to claim 1, wherein said diverting means are capable to contact said primary winding roll and press the web directly against said primary winding roll.

3. The apparatus according to claim 2, wherein said diverting means comprise at least one idle roll contacting said primary winding roll.

4. The apparatus according to claim 2, wherein said diverting means comprise two idle rolls contacting said primary winding roll, said two idle rolls flanking said primary winding roll.

5. The apparatus according to claim 1, wherein said cutting means are able to cut the web at a position between said primary winding rolland said secondary driving means.

6. The apparatus according to claim 1, comprising means for maintaining a substantially constant clearance between said cutting means and said primary winding roll, when said cutting means are in position for cutting the web.

7. The apparatus according claim 1, wherein said cutting means comprise sliding means, whereby said cutting means form at least one part of said diverting means.

8. An apparatus for initiating the winding on a roll of at least one web arriving from a conveyance direction, comprising:

a primary winding roll, secondary driving means for driving the web in a web path; and switching means for switching the web driven in said web path by the secondary driving means to said primary winding roll, said switching means being movable towards said primary winding roll so as to intersect said web path, whereby the web is cut by cutting means and caused to be wound on said primary winding roll;

wherein said switching means comprise:

diverting means for contacting the web, said diverting means being located opposite to said primary winding roll with respect to the web driven by said secondary driving means and said diverting means being movable towards said primary winding roll for causing the web to contact said primary winding roll; and a double pantograph frame, comprising a first pantograph frame and a second pantograph frame disposed symmetrically with respect to each other and operatively linked so that the change of position of said first pantograph frame causes a symmetrical variation of said second pantograph frame, said first pantograph frame having an arm carrying an abutment means and said second pantograph frame having an arm disposed symmetrically to said arm of said first pantograph frame, said arm of said second pantograph frame carrying said cutting means, whereby the abutment of said abutment means on said primary winding roll causes a positioning of said cutting means with respect to said primary winding roll.

9. The apparatus according to claim 8, wherein said abutment means is an idle roll.

10. The apparatus according to claim 8, wherein said abutment means forms at least one part of said diverting means.

11. The apparatus according to claim 8, wherein said cutting means comprise sliding means, whereby said cutting means form at east one part of said diverting means.

12. The apparatus according to claim 8, wherein said cutting means are as wide as the web and are able to cut the web in one stroke.

13. The apparatus according to claim 8, wherein said first pantograph frame and said second pantograph frame are operatively lined by a support and a carriage slidably mounted on said support, wherein:

said carriage defines one arm for each of said first pantograph frame and said second pantograph frames; and said support is linked to each of said first pantograph frame and said second pantograph frame through articulated arms for causing jointly variations of opening of said first pantograph frame and said second pantograph frame.

14. The apparatus according to claim 8, wherein said first pantograph frame and said second pantograph frame are disposed symmetrically to each other with respect of a plane of symmetry, said plane comprising the axis of rotation of said primary winding roll when said double pantograph frame is in position for enabling said abutment means to abut said primary winding roll.

15. The apparatus according to claim 14, wherein said abutment means is an idle roll.

16. The apparatus according to claim 14, wherein said cutting means comprise sliding means, whereby said cutting means form at least one part of said diverting means.

17. An apparatus for initiating the winding on a roll of at least one web arriving from a conveyance direction, comprising:

a primary winding roll, secondary driving means for driving the web in a web path; and switching means for switching the web driven in said web path by the secondary driving means to said primary winding roll, said switching means being movable towards said primary winding roll so as to intersect said web path, whereby the web is cut by cutting means and caused to be wound on said primary winding roll;

wherein said switching means comprise:

diverting means for contacting the web, said diverting means being located opposite to said primary winding roll with respect to the web driven by said secondary driving means and said diverting means being movable towards said primary winding roll for causing the web to contact said primary winding roll; and a double pantograph frame, comprising a first pantograph frame and a second pantograph frame disposed symmetrically with respect of a plane of symmetry, wherein:

said first pantograph frame and said second pantograph frame are operatively linked by a support and a carriage slidably mounted on said support, so that a change of position of said first pantograph frame causes a symmetrical variation of said second pantograph frame, said carriage defines a first arm for each of said first pantograph frame and said second pantograph frame;

said support is linked to each of said first pantograph frame and said second pantograph frame through articulated arms for causing jointly variations of opening of said first pantograph frame and said second pantograph frame;

said first pantograph frame has a second arm carrying an abutment means and said second pantograph frame has a second arm disposed symmetrically to said second arm of said first pantograph frame, said second arm of said second pantograph frame carrying said cutting means, whereby the abutment of said abutment means on said primary winding roll causes a positioning of said cutting means with respect to said primary winding roll; and said plane of symmetry comprises the axis of rotation of said primary winding roll when said double pantograph frame is in position for enabling said abutment means to abut said primary winding roll.

18. The apparatus according to claim 17, wherein said abutment means form at least one part of said diverting means.

19. The apparatus according to claim 17, wherein said cutting means comprise sliding means, whereby said cutting means form at least one part of said diverting means.

20. The apparatus according to claim 17, wherein said abutment means form at least one part of said diverting means and wherein said cutting means comprise sliding means, whereby said cutting means form at least another part of said diverting means.

* * * * *